US007370694B2

(12) United States Patent
Shimizu et al.

(10) Patent No.: US 7,370,694 B2
(45) Date of Patent: May 13, 2008

(54) CONDENSER

(75) Inventors: Yasushi Shimizu, Yokohama (JP); Shunji Kawano, Yokohama (JP); Yuji Fuki, Yokohama (JP); Yoshihiro Iwata, Kawasaki (JP); Yuichi Fukasawa, Yokohama (JP); Yoshio Mochida, Ebina (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 543 days.

(21) Appl. No.: 10/901,986

(22) Filed: Jul. 30, 2004

(65) Prior Publication Data

US 2005/0039891 A1 Feb. 24, 2005

(30) Foreign Application Priority Data

Jul. 30, 2003 (JP) ..... 2003-203462

(51) Int. Cl.
*F28B 1/00* (2006.01)

(52) U.S. Cl. ..... 165/111; 165/114

(58) Field of Classification Search ..... 165/111, 165/113, 114

See application file for complete search history.

(56) References Cited

U.S. PATENT DOCUMENTS

| | | | | | |
|---|---|---|---|---|---|
| 1,578,032 | A | * | 3/1926 | Hodgkinson | 165/114 |
| 1,578,057 | A | * | 3/1926 | Morgan | 165/114 |
| 1,591,769 | A | * | 7/1926 | Morgan | 165/114 |
| 1,764,801 | A | * | 6/1930 | MacNeill | 165/114 |
| 1,776,020 | A | * | 9/1930 | Elliott | 165/114 |
| 1,780,781 | A | * | 11/1930 | Ehrhart | 165/114 |
| 2,312,113 | A | * | 2/1943 | McNulty | 165/114 |
| 2,848,197 | A | * | 8/1958 | Evans, Jr. et al. | 165/114 |
| 4,219,077 | A | * | 8/1980 | Furukawa et al. | 165/114 |
| 4,226,283 | A | * | 10/1980 | Furukawa et al. | 165/114 |
| 4,249,485 | A | * | 2/1981 | Brul et al. | 165/113 |
| 4,254,825 | A | * | 3/1981 | Imazu | 165/114 |
| 4,461,346 | A | * | 7/1984 | Hoshino et al. | 165/114 |

FOREIGN PATENT DOCUMENTS

| | | | | |
|---|---|---|---|---|
| JP | 54068555 | A * | 6/1979 | 165/114 |
| JP | 55-36915 | | 9/1980 | |
| JP | 60014095 | A * | 1/1985 | |
| JP | 8-226776 | | 9/1996 | |
| JP | 2001-153569 | | 6/2001 | |
| WO | WO 02/090719 | | 11/2002 | |

* cited by examiner

*Primary Examiner*—Leonard R Leo
(74) *Attorney, Agent, or Firm*—Oblon, Spivak, McClelland, Maier & Neustadt, P.C.

(57) ABSTRACT

Vertical sectional shapes of portions in which condenser tubes of the upper tube bundle 51 and the lower tube bundle 52 are arranged, in vertical sections of the upper tube bundle 51 and the lower tube bundle 52, are formed to be approximately U-shapes, and a noncondensing air ejection duct 11 is provided to be positioned on a central joint portion of the U-shape of the upper tube portion 51 in an upstream side where circulating water flows first. At a portion in which the condenser tubes are not arranged between the upper and lower tube bundles, steam flow prevention plates 53 are provided to be positioned at both right and left sides of the noncondensing air ejection duct 11.

8 Claims, 8 Drawing Sheets

CONDENSER

CROSS-REFERENCE TO THE INVENTION

This application is based upon and claims the benefit of priority from the prior Japanese Patent Application No. 2003-203462, filed on Jul. 30, 2003; the entire contents of which are incorporated herein by reference.

BACKGROUND OF THE INVENTION

1. Field of the Invention

This invention relates to a condenser installed in a power generating plant and the like for condensing steam turbine exhaust.

2. Description of the Related Art

FIG. 6 and FIG. 7 show a schematic constitution of a conventional condenser, indicating a front elevational view and a side view of the condenser respectively. The condenser includes a huge condenser shell 1 having an approximately square-shape, and a steam turbine 2 is placed on an upper portion of the condenser shell 1. A large number of condenser tubes are housed inside the condenser shell 1, composing a large tube bundle 3.

The tube bundle 3 is supported by a plurality of tube support plates 4 provided along a longitudinal direction of the condenser tube as shown in FIG. 7. Condenser tube plates 5 are provided vertically at both end portions of the condenser tubes, and condenser water boxes 6 are continuously provided at the condenser tube plates 5. Besides, an entrance/exit 7 and an entrance/exit 8 for a circulating medium (generally, circulating water such as seawater, water from a, cooling tower or the like is used) at the condenser tubes are provided to the condenser water boxes 6.

According to the condenser having the above-mentioned structure, steam flowing to the condenser shell 1 from the steam turbine 2 as shown by an arrow in FIG. 6 performs a heat exchange with the circulating water passing inside the condenser tube bundle 3 through the condenser water box 6. The steam lost its latent heat is condensed and gathered to a hot well 9 in a bottom of the condenser shell 1. The circulating water absorbing heat is discharged outside through the condenser water box 6 at the other end of the condenser tubes.

Since a concentration of noncondensing air included in the steam increases gradually when the steam is condensed gradually with its latent heat lost by the circulating water while passing through the tube bundle 3 as described above, the steam which has high noncondensing air concentration is led to an air cooling zone 10 and condensed further to increase the noncondensing air concentration as much as possible. After that, the steam is ejected outside the condenser through a noncondensing air ejection duct 11 by an air ejector (not shown).

Next, technical problems in terms of the condenser and the methods for solving the problems of the conventional condenser will be explained.

In the condenser, steam condensation progresses by a temperature difference between the steam and the circulating water. The temperature whereat the steam is condensed is a saturation temperature for a steam partial pressure in a condensation surface. However, the steam partial pressure is lowered broadly by two factors, and condensation performance (heat exchange efficiency) is lowered by accompanied decrease of the temperature difference. One factor is a pressure loss caused by steam flow, and the other factor is increase of noncondensing air partial pressure by the condensation of noncondensing air mixed in the steam.

Therefore, a reduction of the pressure loss and a prevention of noncondensing air retention are important for achieving performance improvement in the condenser.

In general, exhaust pressure of the steam turbine has relation to the pressure loss of the condenser and the noncondensing air concentration inside the condenser. The exhaust pressure of the steam turbine is a pressure calculated by adding the steam pressure loss in the condenser to a pressure whereat the steam is condensed in the condenser tube bundle. Therefore, when the steam pressure loss in the condenser is large, the exhaust pressure of the steam turbine is increased and a turbine output is lowered, as a result of which, power generating efficiency is reduced. Thus, to keep the steam pressure loss low in the condenser and to lead the steam to the air cooling zone smoothly without steam retention in the condenser tube bundle are important technical problems as performance indexes of the condenser.

In the conventional condenser, two different types of forms mainly respond to these problems. One of them is to provide a steam passage space wide enough around the condenser tube bundles arranged comparatively centered. (For example, refer to Japanese Patent Laid-open Application No. Hei 8-226776.)

The other form is to provide a steam passage wide enough in the tube bundles arranged sparsely as a whole in a wide range. (For example, refer to Japanese Patent Publication No. Sho. 55-36915.)

Demerits of the former of these types of forms are that the whole size of the condenser is enlarged by taking the surrounding steam passage space widely and that the pressure loss is comparatively large because the steam passes by a large number of condenser tubes until reaching the air cooling zone. The demerit of the latter is that a steam retention area in the tube bundle tends to be made because a path of the steam in the tube bundle toward the air cooling zone is complicated.

The above-mentioned condenser shown in FIG. 6 and FIG. 7 is a one-path type condenser in which the circulating water flows in from one condenser water box 6 and flows out to the other condenser water box 6, however, there exist in general a two-path type condenser in which one condenser water box has an entrance and an exit for the circulating water and the circulating water turns back at the other condenser water box.

FIG. 8 shows a sectional construction of one example of the two-path type condenser of which tube bundle is divided into upper and lower bundles. This condenser is so constructed that the circulating water flows in from an upper bundle 31 provided above and flows out from a lower bundle 32 provided below, or on the other hand, that the circulating water flows in from the lower bundle 32 and flows out from the upper bundle 31. In addition, the upper and lower bundles are partitioned by a partition plate 33. (For example, refer to Japanese Patent Application Laid-open No. 2001-153569.)

Since the outermost periphery length of the tube bundles is longer than the condenser having one tube bundle by dividing the bundle into two in such two-path type condenser, steam speed whereat the steam flows in the tube bundle is reduced. As a result, an effect that the pressure loss of the steam generated in the tube bundle is suppressed can be obtained. However, since the air cooling zone 10 and the noncondensing air ejection duct 11 are required to be provided at respective tube bundles by dividing the tube bundle into two, there exists disadvantages that a structure is complicated, and a manufacturing cost increases.

SUMMARY OF THE INVENTION

An object of the present invention is to provide a condenser capable of suppressing increase of a steam pressure loss and noncondensing air retention, of which a manufacturing cost is low and heat exchange efficiency is good without incurring the complication of structure.

A condenser of the present invention is a condenser which houses a tube bundle formed by arranging a large number of condenser tubes in a condenser shell isolated from an outside, and allows a circulating medium to flow through the condenser tubes to condense a steam turbine exhaust introduced into the condenser shell at the outer surface of the condenser tubes, in which the tube bundle is composed of an upper tube bundle and a lower tube bundle arranged below the upper tube bundles, in which the tube bundle is constructed so that the circulating medium flows in the condenser tubes in the upper tube bundle and in the condenser tubes in the lower tube bundle in inverse directions respectively as a two-path turning-back type structure, the condenser includes: a noncondensing air ejection duct provided only in one tube bundle positioned at an upstream side in a flowing direction of the circulating medium, of the upper tube bundle and lower tube bundle, and provided at an approximately center of a width direction in a vertical section of the tube bundle; and steam flow prevention plates of which upper and lower ends reach the upper tube bundle and the lower tube bundle provided at a portion in which the condenser tubes are not arranged between the upper tube bundle and the lower tube bundle, to be positioned at both right and left sides of the noncondensing air ejection duct.

Furthermore, the condenser of the present invention is a condenser which houses a tube bundle formed by arranging a large number of condenser tubes in a condenser shell isolated from the outside, and allows a circulating medium to flow through the condenser tubes to condense a steam turbine exhaust introduced into the condenser shell at the outer surface of the condenser tubes, in which the tube bundle is composed of an upper tube bundle and a lower tube bundle arranged below the upper tube bundles, in which the tube bundle is constructed so that the circulating medium flows in the condenser tubes in the upper tube bundle and in the condenser tubes in the lower tube bundle in inverse directions respectively as a two-path turning-back type structure, the condenser includes: a noncondensing air ejection duct of which vertical sectional shape in a vertical section of the tube bundle is approximately C-shape, and of which an opening faces in a central direction of the tube bundle provided only in one tube bundle positioned at an upstream side in a flowing direction of the circulating medium, of the upper tube bundle and the lower tube bundle; and steam flow prevention plates of which upper and lower ends reach the upper tube bundle and the lower tube bundle provided at a portion in which the condenser tubes are not arranged between the upper tube bundle and the lower tube bundle, to be positioned at both right and left sides of the noncondensing air ejection duct.

DESCRIPTION OF THE EMBODIMENTS

Hereinafter, embodiments of the present invention will be described in detail with reference to the drawings.

Figure 1:
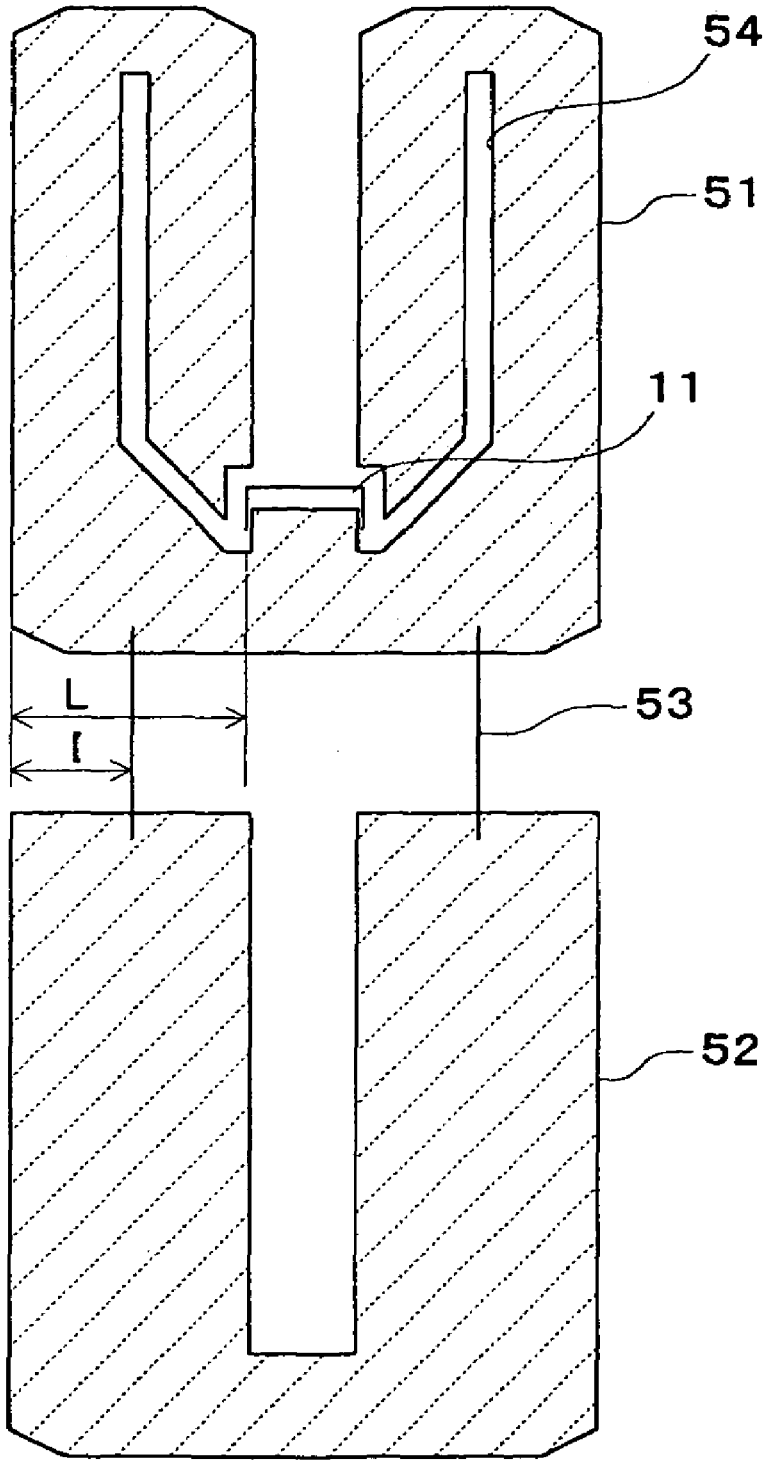
FIG. 1 is a schematic sectional view of a tube bundle portion of a condenser according to a first embodiment of the present invention.

FIG. 1 shows a sectional constitution of a tube bundle of a condenser according to a first embodiment of the present invention.

As shown in FIG. 1, the condenser according to the present embodiment is a two-path circulating water type condenser of which a tube bundle composed of a large number of condenser tubes arranged in a horizontal direction is divided into an upper tube bundle 51 and a lower tube bundle 52 placed below the upper tube bundle 51. Circulating water flows first in the respective condenser tubes of the upper tube bundle (path-1 tube bundle) 51 through a turning-back condenser water box (not shown) provided at one end portion of the tube bundle, and flows in the respective condenser tubes of the lower tube bundle (path-2 tube bundle) 52 in an inverse direction.

Vertical sectional shapes of portions in which the condenser tubes of the above-mentioned upper tube bundle 51 and lower tube bundle 52 are arranged, at vertical sections to a width direction of the upper tube bundle 51 and the lower tube bundle 52, are formed to be approximately U-shapes. A noncondensing air ejection duct 11 is provided only at the upper tube bundle 51 of an upstream side, where the circulating water flows first, of the upper tube bundle 51 and the lower tube bundle 52. The noncondensing air ejection duct 11 is provided to be positioned above a central joint portion of the U-shape of the upper tube bundle 51 of which whole condenser tubes are arranged in the U-shape, namely, provided at an approximately center of the width direction at the vertical section of the upper tube bundle 51, of which vertical sectional shape in the width direction is an approximately C-shape so that an opening thereof faces downside.

At a portion where the condenser tubes are not arranged between the upper tube bundle 51 and the lower tube bundle 52, two steam flow prevention plates 53 in total are provided with each plate provided at one side respectively, so that the positions thereof in the horizontal direction are both right and left sides of the above-mentioned noncondensing air ejection duct 11. The steam flow prevention plates 53 are so formed that both end portions in length directions thereof reach the condenser tube plates to which both end portions of the condenser tubes are fixed, along the length directions of the upper tube bundle 51 and the lower tube bundle 52, and of which end portions of up-and-down directions are formed to reach the lower end portions of the upper tube bundle 51 and the upper end portions of the lower tube bundle 52, arranged to be approximately vertical.

The above-mentioned steam flow prevention plate 53 is arranged at a position, as shown in FIG. 1, when each width of the upper tube bundle 51 at both right and left sides of the noncondensing air ejection duct 11 is denoted by "L", and when a distance from an outer side of the upper tube bundle 51 to the steam flow prevention plate 53 is denoted by "1", in the vertical section of the upper tube bundle 51 and lower tube bundle 52, to be defined by $0.3 \leqq 1/L \leqq 0.7$.

In this embodiment, the steam flow prevention plates 53 is so arranged that the above-mentioned 1/L is to be approximately 0.5.

Additionally, a steam passage 54 which is formed to leave a slit without arranging the condenser tubes is provided inside the upper tube bundle 51, constructed to form a steam flow from inside the upper tube bundle 51 to the noncondensing air ejection duct 11.

Figure 6:
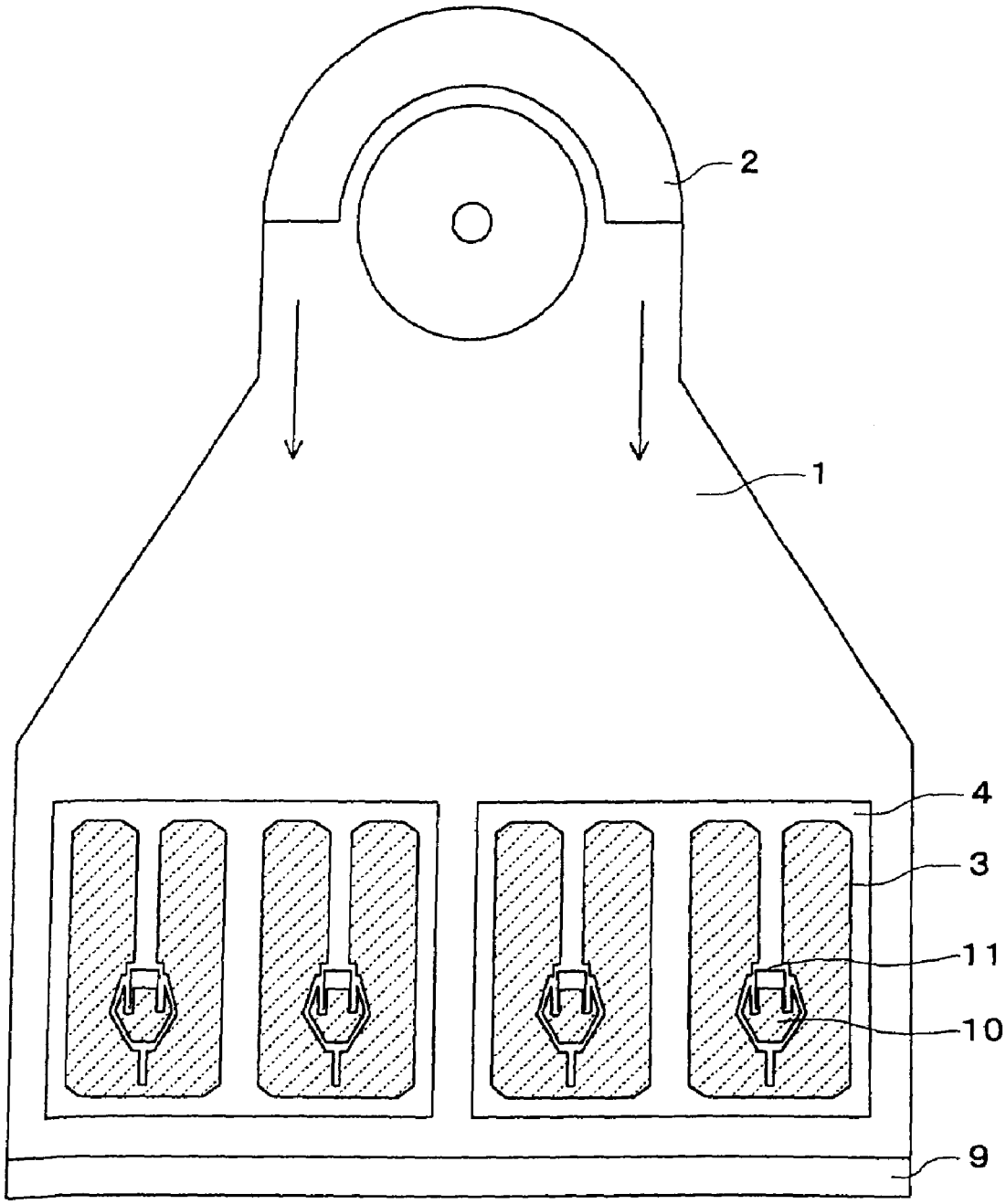
FIG.6 PRIOR ART
FIG. 6 is a schematic sectional view of a front-surface side of a conventional condenser.
Figure 7:
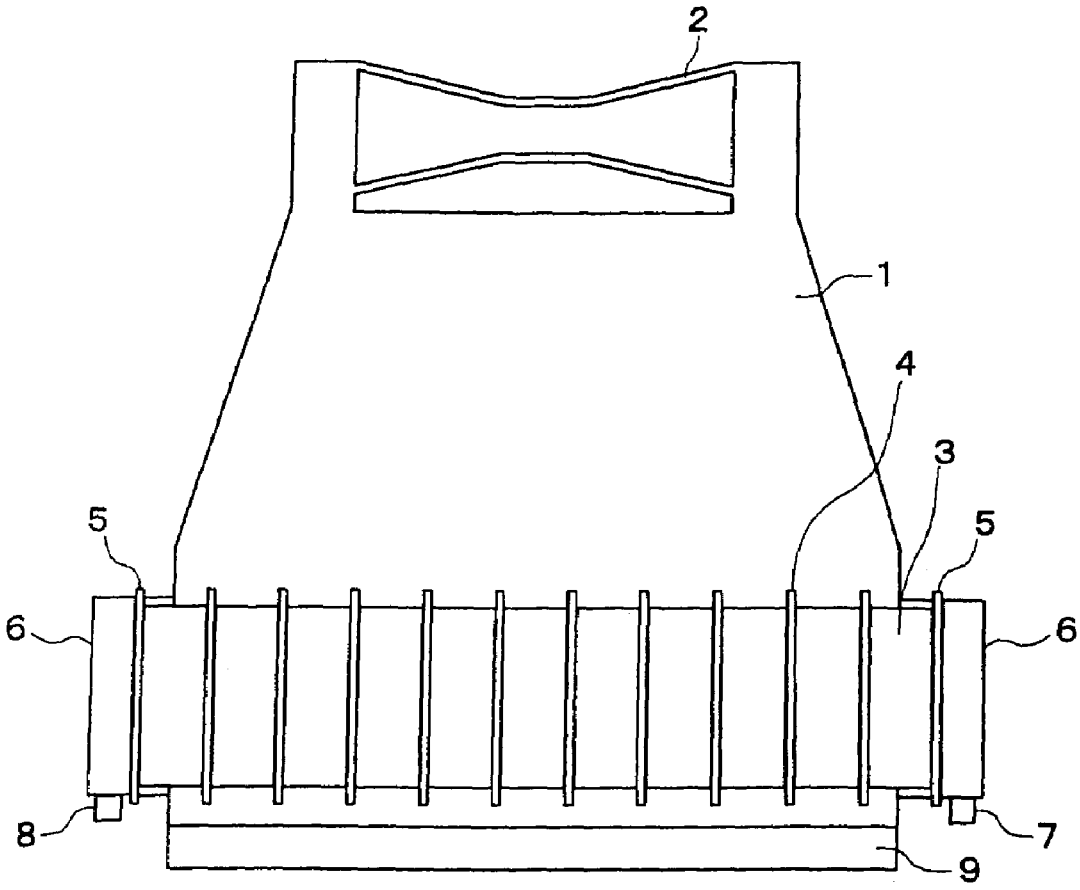
FIG. 7 PRIOR ART
FIG. 7 is a schematic sectional view of a side-surface side of a conventional condenser.

The tube bundles of the above-constitution are housed in the condenser shell 1 and supported by the plural tube support plates 4 provided along the longitudinal direction of the condenser tubes, and the condenser tube plates 5 are provided at the both end portions of the condenser tubes, in the same way as the condenser shown in FIG. 6 and FIG. 7.

Figure 8:
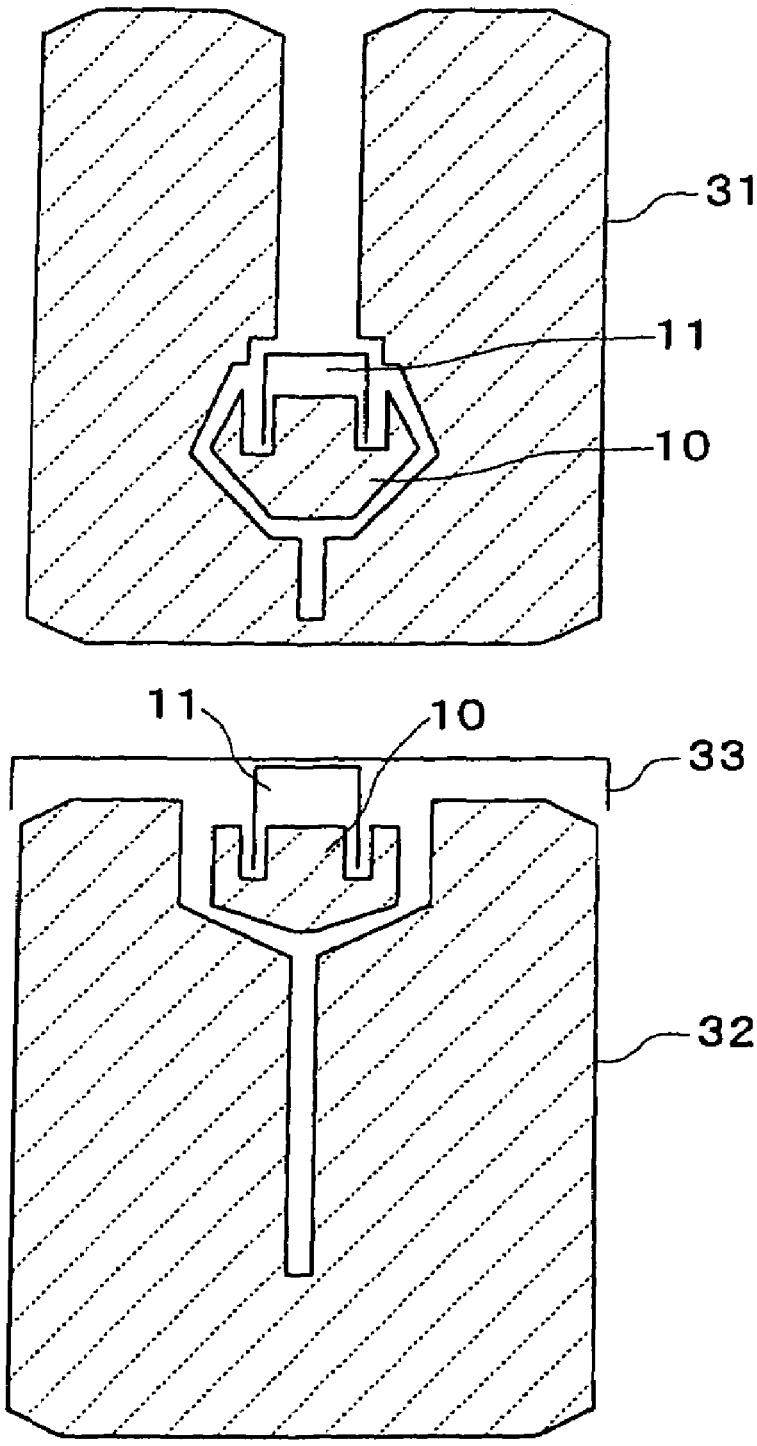
FIG. 8 PRIOR ART
FIG. 8 is a schematic sectional view of a tube bundle portion of a conventional two-path type condenser.

Since in the above-constructed condenser of the present embodiment, the noncondensing air ejection duct 11 is provided only in the upper tube bundle 51 of an entrance side for the circulating water, the structure can be simplified and a manufacturing cost can be reduced as compared with the conventional two-path circulating water type condenser having the structure as shown in FIG. 8.

By providing the noncondensing air ejection duct 11 in the upper tube bundle 51 where temperature of the circulating water is low at the entrance side for the circulating water, pressure inside the noncondensing air ejection duct 11 can be kept at a minimum value in the tube bundle section. Therefore, the steam flows toward the noncondensing air ejection duct 11, so that retention inside the tube bundle for the noncondensing air which is condensed in the steam can be suppressed.

Furthermore, in the condenser of the present embodiment, by providing the steam flow prevention plates 53, a flow direction of the steam toward the noncondensing air ejection duct 11 can be confined. Namely, if the steam flow prevention plates 53 are not provided, the steam also flows into the lower tube bundle 52 from between the upper tube bundle 51 and the lower tube bundle 52, so that the steam flow from above collides with the steam flow from below in the lower tube bundle 52, and as a result, the flow toward the noncondensing air ejection duct 11 is hindered. Since in the present embodiment, the steam flow prevention plates 53 are provided, the steam flowing in from between the upper tube bundle 51 and the lower tube bundle 52 is shut off by the steam flow prevention plates 53, so that generation of the steam flow from above can be suppressed in the lower tube bundle 52, and the steam which passed through the lower tube bundle 52 is easy to flow upwards, toward the noncondensing air ejection duct 11 to thereby suppress the retention of the noncondensing air inside the lower tube bundle 52. Besides, since the upper and bottom ends of the steam flow prevention plates 53 reach the bottom end of the upper tube bundle 51 and the upper end of the lower tube bundle 52, the steam toward the noncondensing air ejection duct 11 certainly passes through the upper tube bundle 51 and the lower tube bundle 52, so that occurrence of what is called a short-path where the steam flows directly towards the noncondensing air ejection duct 11 can be suppressed.

Figure 2:
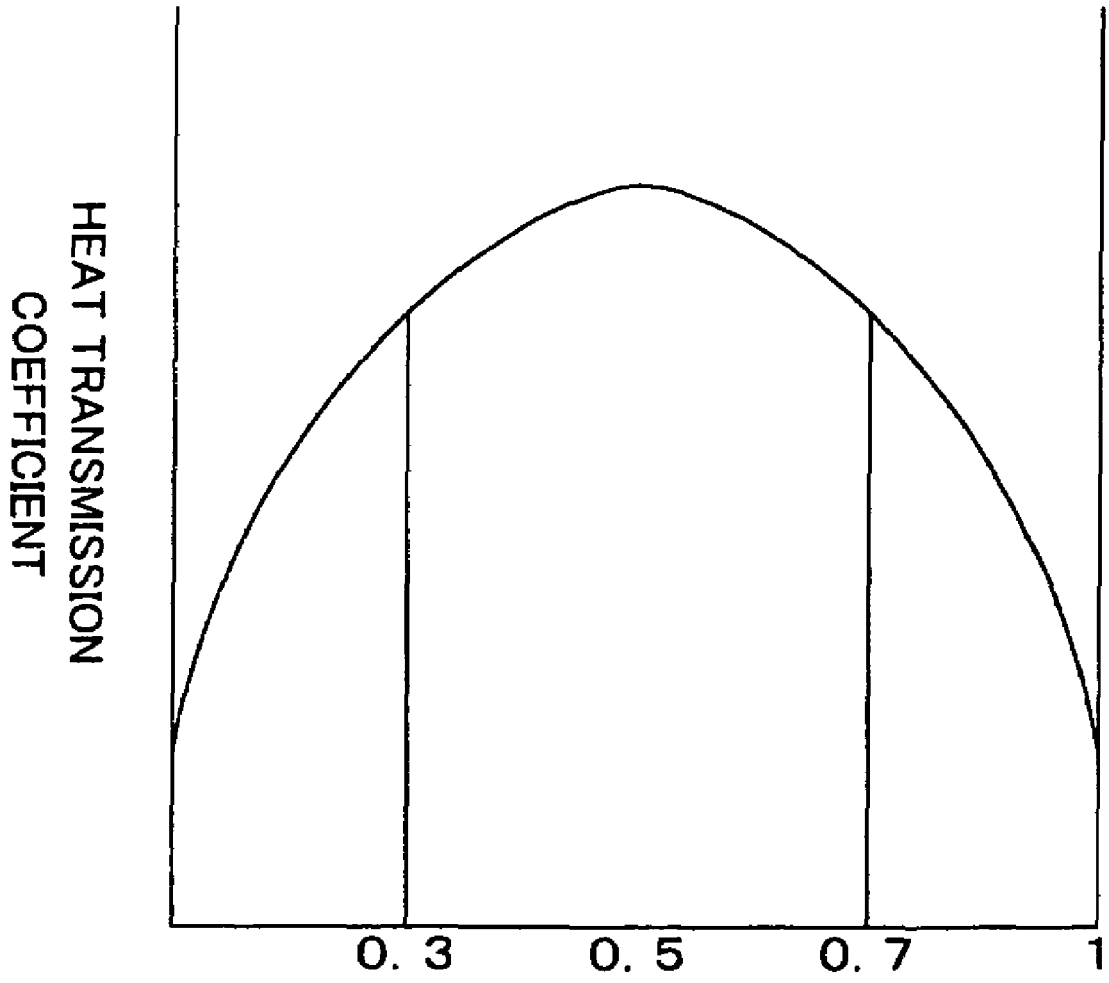
FIG. 2 is a graph showing a relation between a position of a steam flow prevention plate and heat transmission coefficient of the condenser according to the present invention.

FIG. 2 is a graph showing a calculated result of a relation between 1/L and a heat transmission coefficient, when a vertical axis denotes the heat transmission coefficient and a horizontal axis denotes a ratio of "1" to "L" as described above i.e. a value of 1/L. As shown in FIG. 2, when the value of 1/L is approximately 0.5, namely, when the position of the steam flow prevention plate 53 is approximately at the center of each width of right-and-left tube bundle of the noncondensing air ejection duct 11, the heat transmission coefficient is the highest, and by making the value of 1/L be within the range of $0.3 \leqq 1/L \leqq 0.7$, reduction of the heat transmission coefficient is suppressed and the condenser whereof a heat exchange performance is high can be constructed.

As described above, in the case that the steam flow prevention plates 53 are placed too near to the outside of the tube bundle, or in the case that the steam flow prevention plates 53 are placed too inside in the tube bundle, the reason why the heat transmission coefficient varies in accordance with the positions in the horizontal direction of the steam flow prevention plates 53 is that the short-path where the steam flow which passed slightly through the upper tube bundle 51 or the lower tube bundle 52 enters between the upper and lower tube bundles and flows toward the noncondensing air ejection duct 11 tends to occur, and that the pressure between the upper and lower tube bundles, below the noncondensing air ejection duct 11 is higher than the pressure inside the lower tube bundles 52, as a result of which, the steam flow which passes through the lower tube bundle 52 is obstructed.

Since the noncondensing air ejection duct 11 is arranged to be positioned at the center of the right-and-left width direction of the upper tube bundle 51 in the present embodiment, the steam flowing into the tube bundle from right and left flows together at the center with equable flow amount and flows out into the noncondensing air ejection duct 11. Thereby, the pressure loss of the steam in the tube bundle can be suppressed to be small and at the same time, the retention of the noncondensing air in the tube bundle can be suppressed.

Furthermore, in the present embodiment, the vertical sectional shapes in the width direction of the portions in which the condenser tubes of the upper tube bundle 51 and the lower tube bundle 52 are arranged, are formed into approximately the U-shapes. The noncondensing air ejection duct 11 of which vertical sectional shape in the width direction described above is approximately the C-shape is placed at the central joint portion of the U-shape of the upper tube bundle 51 so that the opening thereof faces downside. Thereby, the upper tube bundle 51 positioned below the noncondensing air ejection duct 11 functions as an air cooling zone. At the same time, since a steam inflow area to the upper tube bundle 51 and the lower tube bundle 52 can be enlarged by constructing the upper tube bundle 51 and the lower tube bundle 52 into the U-shapes, a steam inflow speed can be slower and the pressure loss of the steam stream inside the upper tube bundle 51 and the lower tube bundle 52 can be small. In addition, by arranging the opening of the noncondensing air ejection duct 11 to face downside, the inflow of condensed liquid into the noncondensing air ejection duct 11 can be prevented.

In the above-described upper tube bundle 51, the steam flows downward in the right-and-left tube bundles through between the noncondensing air ejection duct 11 and the steam flow prevention plates 53, then cooled further in the tube bundle below the noncondensing air ejection duct 11 and discharged to the noncondensing air ejection duct 11. Since positions of the steam flow prevention plates 53 have a suitable distance from the noncondensing air ejection duct 11 at this time, unnecessary pressure loss does not occur between the noncondensing air ejection duct 11 and the steam flow prevention plates 53. When the steam stream which flows through the lower tube bundle 52 to the noncondensing air ejection duct 11 passes between the right-and-left of the steam flow prevention plates 53, the steam flow prevention plates 53 have a suitable distance from each other, so that the flow passing through there does not cause the unnecessary pressure loss.

Figure 3:
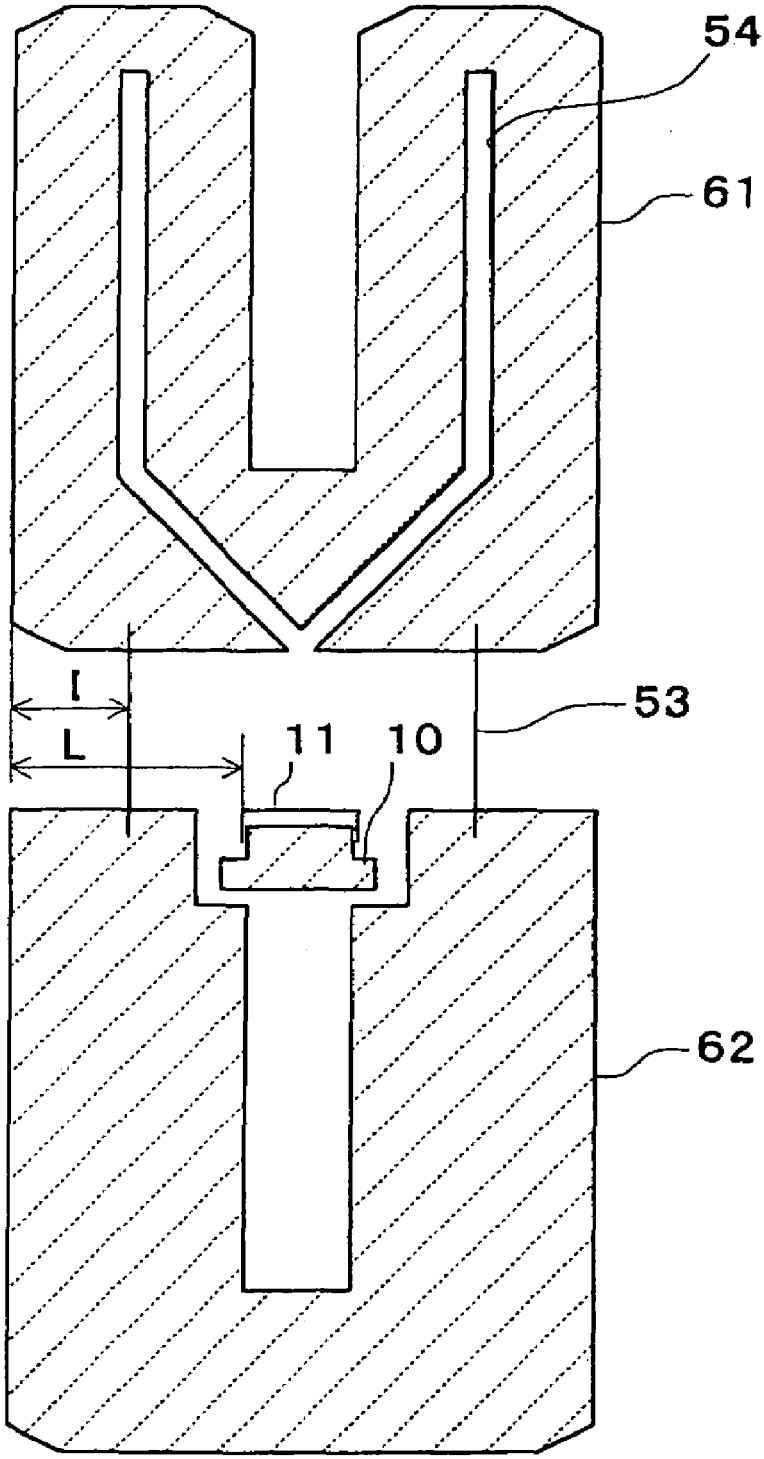
FIG. 3 is a schematic sectional view of a tube bundle portion of a condenser according a second embodiment of the present invention.

Next, a second embodiment of the present invention will be described. FIG. 3 shows a sectional constitution of a tube bundle of a condenser relating to the second embodiment of the present invention.

A condenser according to the present embodiment is, as in the embodiment described above, a two-path circulating water type condenser composed of an upper tube bundle 61 and a lower tube bundle 62 arranged below the upper tube bundle 61. Circulating water flows first in respective condenser tubes of the lower tube bundle 62 (path-1 tube bundle), then passes through a turning-back condenser water box (not shown) provided at one end portion of the tube bundle, and flows in respective condenser tubes of the upper tube bundles 61 (path-2 tube bundle) in an inverse direction. The noncondensing air ejection duct 11 is provided only in the lower tube bundle 62 in which the circulating water flows first, of the upper tube bundle 61 and the lower tube bundle 62.

The noncondensing air ejection duct 11 is provided to be positioned above a central joint portion of a U-shape of the lower tube bundle 62 of which whole condenser tubes are arranged in the U-shape, namely, provided on the approximately center of a width direction at a vertical section of the lower tube bundle 62. The vertical sectional shape of the noncondensing air ejection duct 11 in the width direction is an approximately C-shape so that an opening thereof faces downside.

Two steam flow prevention plates 53 in total formed as the same way as in the first embodiment described above are provided at a portion where the condenser tubes are not arranged between the upper tube bundle 61 and the lower tube bundle 62.

The above-mentioned steam flow prevention plate 53 is arranged at a position, as shown in FIG. 3, when each width of the lower tube bundle 62 at both right and left sides of the noncondensing air ejection duct 11 is denoted by "L", and when a distance from an outer side of the lower tube bundle 62 to the steam flow prevention plate 53 is denoted by "1", in the vertical section of the upper tube bundle 61 and lower tube bundle 62, to be defined by $0.3 \leqq 1/L \leqq 0.7$.

In this embodiment, the steam flow prevention plate 53 is so arranged that the above-mentioned 1/L is to be approximately 0.5.

Furthermore, the steam passage 54 which is formed to leave a slit without arranging the condenser tubes is provided inside the upper tube bundle 61, constructed to form a steam flow from inside the upper tube bundle 61 to the noncondensing air ejection duct 11.

In the above-constructed embodiment, a point that the lower tube bundle 62 is an entrance side for the circulating water (path-1 tube bundle) is different from the first embodiment described above. By providing the noncondensing air ejection duct 11 only in the lower tube bundle 62 at the entrance side for the circulating water, the same effect as the first embodiment can be obtained.

Figure 4:
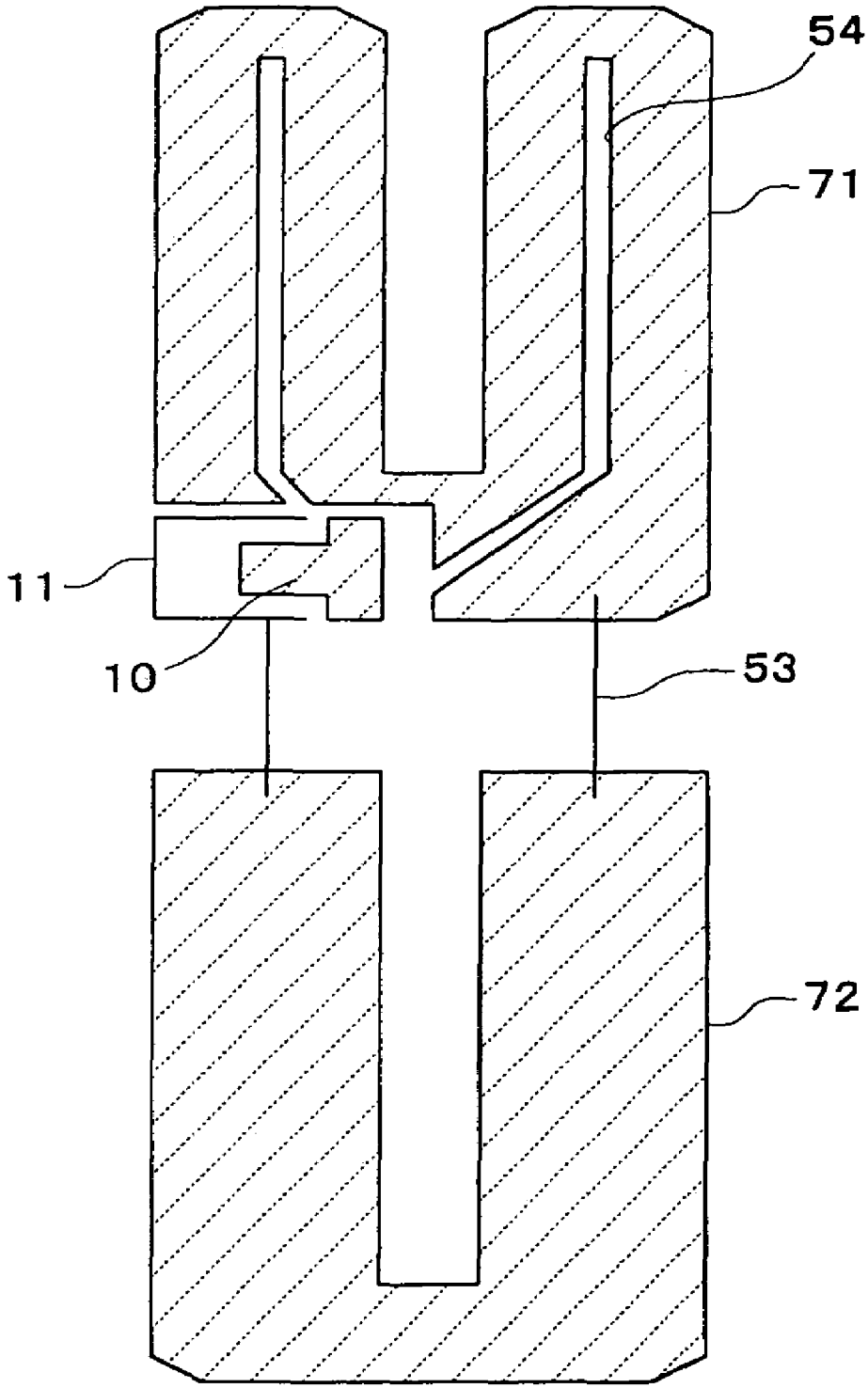
FIG. 4 is a schematic sectional view of a tube bundle portion of a condenser according a third embodiment of the present invention.

Next, a third embodiment of the present invention will be described. FIG. 4 shows a sectional constitution of a tube bundle of a condenser according to the third embodiment of the present invention.

A condenser according to the present embodiment, as in the first embodiment descried above, circulating water flows first in respective condenser tubes of an upper tube bundle (path-1 tube bundle) 71, then passes through a turning-back condenser water box (not shown) arranged at one end portion of the tube bundle, and flows in respective condenser tubes of the lower tube bundle (path-2 tube bundle) 72 in an inverse direction. Between the upper and lower tube bundles, two steam flow prevention plates 53 in total are provided, with each plate provided at both right and left sides, as in the first and second embodiments.

The noncondensing air ejection duct 11 is formed to have an approximately C-shaped vertical section at the vertical section to a width direction of the upper tube bundle (path-1 tube bundle) 71 and the lower tube bundle (path-2 tube bundle) 72. The noncondensing air ejection duct 11 is provided at one end portion of a width direction of the tube bundle of the lower portion inside the upper tube bundle 71 (path-1 tube bundle) which is an entrance side for circulating water (a width direction at the vertical section of the upper tube bundle <path-1 tube bundle>71) so that an opening thereof faces to a central direction of the tube bundle, and the air cooling zone 10 is provided in the opening. Besides, the condenser is so constructed that there does not exist a large gap between the upper surface of the noncondensing air ejection duct 11 and the upper tube bundle 71.

Since the noncondensing air ejection duct 11 is provided only in the upper tube bundle (path-1 tube bundle) 71 which is the entrance side for the circulating water in the above-constructed embodiment, a structure can be simplified and a manufacturing cost can be reduced as compared with the conventional two-path circulating water type condenser having the structure shown in FIG. 8.

In addition, by providing the noncondensing air ejection duct 11 at the upper tube bundle 71 of the entrance side for the circulating water in which the temperature of the circulating water is low, pressure in the noncondensing air ejection duct 11 can be kept at a minimum value in the tube bundle section. Thereby, the steam flows toward the noncondensing air ejection duct 11, so that retention of the noncondensing air condensed in the steam inside the tube bundle can be suppressed.

Furthermore, in the condenser of the present embodiment, by providing the steam flow prevention plate 53, a steam stream direction toward the noncondensing air ejection duct 11 can be confined, and thereby a short-path where the steam flows directly to the noncondensing air ejection duct 11 can be restrained from occurring as described above.

In the present embodiment, the noncondensing air ejection duct 11 is provided at the end portion in the above-described width direction of the tube bundle of the upper tube bundle 71, facing sideways. Therefore, a pipe for discharging the noncondensing air from the noncondensing air ejection duct 11 can be arranged to be drawn out in a lateral direction without being passed through the tube bundle in an up-and-down direction, as a result, a manufacture thereof can be performed easily and the manufacturing cost can be substantially reduced.

Figure 5:
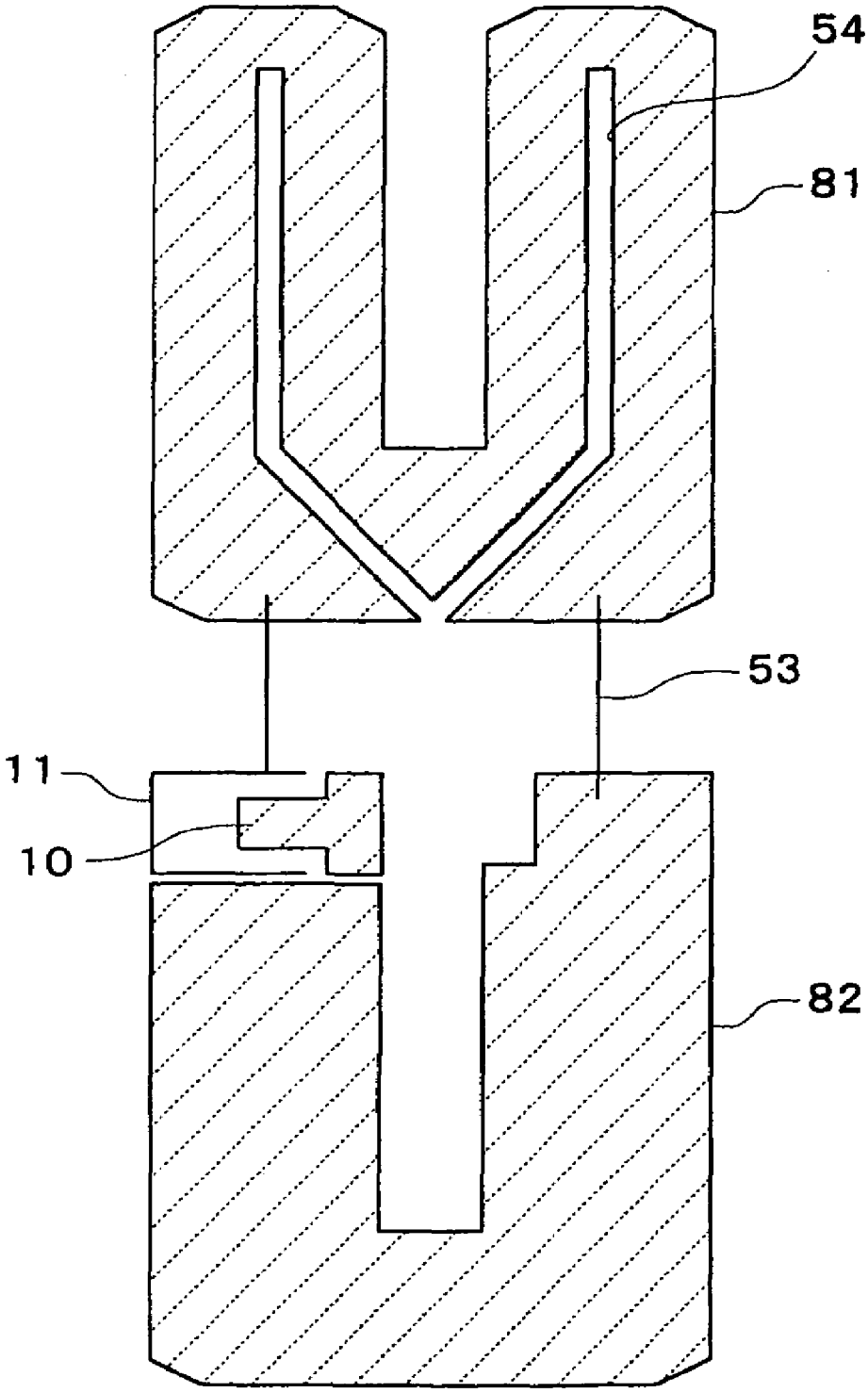
FIG. 5 is a schematic sectional view of a tube bundle portion of a condenser according to a fourth embodiment of the present invention.

Next, a fourth embodiment of the present invention will be described. FIG. 5 shows a sectional constitution of a tube bundle of a condenser according to the fourth embodiment of the present invention.

In a condenser according to the present embodiment, on the contrary to the third embodiment described above, circulating water flows first in respective condenser tubes of a lower tube bundle (path-1 tube bundle) 82, then passes through a turning-back condenser water box (not shown) provided at one end portion of the tube bundle, and flows in respective condenser tubes of an upper tube bundle (path-2 tube bundle) in an inverse direction.

The noncondensing air ejection duct 11 is formed to have an approximately C-shaped vertical section at the vertical section to a width direction of the upper tube bundle (path-2 tube bundle) 81 and the lower tube bundle (path-1 tube bundle) 82. The noncondensing air ejection duct 11 is placed at one end portion of a width direction (a width direction at a vertical section of the lower tube bundle <path-1 tube bundle>) of the tube bundle of an upper portion inside the lower tube bundle (path-1 tube bundle) 82 which is an entrance side for the circulating water so that an opening thereof faces to a central direction of the tube bundle. Besides, the condenser is so constructed that there does not exist a large gap between the lower surface of the noncondensing air ejection duct 11 and the lower tube bundle 82.

The same effect as the third embodiment described above can be also obtained in the present embodiment thus constructed.

As clarified by the above description, according to the present invention, a condenser capable of suppressing increase of the steam pressure loss and the retention of the noncondensing air, without incurring the complication of the structure, of which the manufacturing cost is low and the heat exchange performance is good can be provided.

What is claimed is:

1. A condenser which houses a tube bundle formed by arranging a number of condenser tubes in a condenser shell isolated from an outside, and allows a circulating medium to flow through the condenser tubes to condense a steam turbine exhaust introduced into the condenser shell at an outer surface of the condenser tubes, wherein the tube bundle comprises an upper tube bundle and a lower tube bundle arranged below the upper tube bundle, and wherein the tube bundle is constructed so that the circulating medium flows in the condenser tubes in the upper tube bundle and in the condenser tubes in the lower tube bundle in inverse directions respectively as a two-path turning-back type structure, the condenser comprising:

a noncondensing air ejection duct provided only in one tube bundle positioned at an upstream side in a flowing direction of the circulating medium, of the upper tube bundle and the lower tube bundle, and provided at an approximately center of a width direction in a vertical section of the tube bundle; and steam flow prevention plates of which upper and lower ends reach the upper tube bundle and the lower tube bundle provided at a portion in which the condenser tubes are not arranged between the upper tube bundle and the lower tube bundle, to be positioned at both right and left sides of the noncondensing air ejection duct, wherein said stream flow prevention plate is arranged at a position, when each width of the tube bundle at both right and left sides of said noncondensing air ejection duct is denoted by "L", and when a distance from an outer side of the tube bundle to said steam flow prevention plate is denoted by "1", in the vertical section to the longitudinal direction of said tube bundle, to be defined by $0.3 \leqq 1/L \leqq 0.7$.

2. The condenser as set forth in claim 1, wherein the upper tube bundle is formed to be an upstream side of the circulating medium;

wherein a vertical sectional shape in the width direction of a portion, in which the condenser tubes of the upper tube bundle are arranged, is formed to be an approximately U-shape; and wherein said noncondensing air ejection duct is positioned at a central joint portion of the U-shape, of which vertical sectional shape in the width direction is an approximately C-shape with an opening thereof faced downside.

3. The condenser as set forth in claim 1, wherein the lower tube bundle is formed to be the upstream side of the circulating medium;

wherein a vertical sectional shape in the width direction of a portion, in which the condenser tubes of the lower tube bundle are arranged, is formed to be an approximately U-shape; and wherein said noncondensing air ejection duct is positioned at a central opening portion of the U-shape, of which vertical sectional shape in the width direction is an approximately C-shape with an opening thereof faced downside.

4. The condenser as set forth in claim 1, wherein the upper tube bundle is formed to be an upstream side of the circulating medium;

wherein a vertical sectional shape in the width direction of a portion, in which the condenser tubes of the upper tube bundle are arranged, is formed to be an approximately U-shape; and wherein said noncondensing air ejection duct is positioned at a central joint portion of the U-shape, of which vertical sectional shape in the width direction is an approximately C-shape with an opening thereof faced downside.

5. The condenser as set forth in claim 1, wherein the lower tube bundle is formed to be an upstream side of the circulating medium;

wherein a vertical sectional shape in the width direction of a portion, in which the condenser tubes of the lower tube bundle are arranged, is formed to be an approximately U-shape; and wherein said noncondensing air ejection duct is positioned at a central opening portion of the U-shape, of which vertical sectional shape in the width direction is an approximately C-shape with an opening thereof faced downside.

6. A condenser which houses a tube bundle formed by arranging a number of condenser tubes in a condenser shell isolated from an outside, and allows a circulating medium to flow through the condenser tubes to condense a steam turbine exhaust introduced into the condenser shell at an outer surface of the condenser tubes, wherein the tube bundle comprises an upper tube bundle and a lower tube bundle arranged below the upper tube bundle, and wherein the tube bundle is constructed so that the circulating medium flows in the condenser tubes in the upper tube bundle and in the condenser tubes in the lower tube bundle in inverse directions respectively as a two-path turning-back type structure, the condenser comprising:

noncondensing air ejection duct of which vertical sectional shape in a vertical section of the tube bundle is an approximately C-shape, and of which an opening faces in a central direction of the tube bundle provided only in one tube bundle positioned at an upstream side in a flowing direction of the circulating medium, of the upper tube bundle and the lower tube bundle; and steam flow prevention plates of which upper and lower ends reach the upper tube bundle and the lower tube bundle provided at a portion in which the condenser tubes are not arranged between the upper tube bundle and the lower tube bundle, to be positioned at both right and left sides of the noncondensing air ejection ducts, wherein said stream flow prevention plate is arranged at a position, when each width of the tube bundle at both right and left sides of said noncondensing air ejection duct is denoted by "L", and when a distance from an outer side of the tube bundle to said steam flow prevention plate is denoted by "1", in the vertical section to the longitudinal direction of said tube bundle, to be defined by $0.3 \leqq 1/L \leqq 0.7$.

7. The condenser as set forth in claim 6, wherein the upper tube bundle is formed to be an upstream side of the circulating medium;

wherein a vertical sectional shape of a portion in which the condenser tubes of the upper tube bundle are arranged, in the vertical section of the tube bundle, is formed to be an approximately U-shape; and wherein said noncondensing air ejection duct is positioned at a lower portion of either one side of right or left of the upper tube bundle.

8. The condenser as set forth in claim 6, wherein the lower tube bundle is formed to be the upstream side of the circulating medium;

wherein a vertical sectional shape of a portion in which the condenser tubes of the lower tube bundle are arranged, in the vertical section of the tube bundle, is formed to be an approximately U-shape; and wherein said noncondensing air ejection duct is positioned at an upper portion of either one side of right or left of the lower tube bundle.

* * * * *